US009731530B1

(12) United States Patent
Shih

(10) Patent No.: US 9,731,530 B1
(45) Date of Patent: Aug. 15, 2017

(54) POSITIONING BASE FOR AN EMBOSSING SEAL

(71) Applicant: Sun Same Enterprises Co., Ltd., Tainan (TW)

(72) Inventor: Wen-Jer Shih, Tainan (TW)

(73) Assignee: Sun Same Enterprises Co., Ltd., Tainan (TW)

( * ) Notice: Subject to any disclaimer, the term of this patent is extended or adjusted under 35 U.S.C. 154(b) by 0 days.

(21) Appl. No.: 15/234,699

(22) Filed: Aug. 11, 2016

(51) Int. Cl.
*B44B 5/00* (2006.01)
*B41K 3/38* (2006.01)

(52) U.S. Cl.
CPC ..... *B41K 3/38* (2013.01); *B44B 5/0052* (2013.01); *B44B 5/0085* (2013.01)

(58) Field of Classification Search
CPC ... B44B 5/0023; B44B 5/0038; B44B 5/0052; B44B 5/0085; B44B 5/026; B41K 3/38; B41K 3/36; B41K 5/006
USPC ..... 101/31.1
See application file for complete search history.

(56) References Cited

U.S. PATENT DOCUMENTS 2,080,987 A * 5/1937 Priesmeyer ..... B44B 5/0085 101/31.1
4,278,017 A * 7/1981 Conjura ..... B44B 5/0085 101/31.1
2005/0126407 A1* 6/2005 Hixon ..... B31F 1/07 101/31.1

* cited by examiner

*Primary Examiner* — Leslie J Evanisko
(74) *Attorney, Agent, or Firm* — C. G. Mersereau; Nikolai & Mersereau, P.A.

(57) ABSTRACT

A positioning base for an embossing seal has a stand and a positioning assembly mounted on a top of the stand. The stand has two supports on one end and two limit blocks on the other end. The supports are respectively disposed on two sides of the positioning assembly, and the two limit blocks are respectively disposed on the two sides of the positioning assembly. The positioning base can be detachably assembled with a handheld embossing seal together as a desktop embossing seal for use on a desk. The supports and the limits clamp and limit the base of the handheld embossing seal, and the positioning assembly clamps an end of the base. The positioning base provides a firm foundation with the handheld embossing seal, such that the handheld embossing seal can be put on a desk for use, thereby enhancing the stability.

9 Claims, 5 Drawing Sheets

POSITIONING BASE FOR AN EMBOSSING SEAL

BACKGROUND OF THE INVENTION

1. Field of the Invention

The present invention relates to a positioning base for an embossing seal, especially to a positioning base for an embossing seal that can be assembled with a handheld embossing seal to become a desktop embossing seal.

2. Description of the Prior Arts

A conventional embossing seal includes the following two types: the handheld embossing seal and the desktop embossing seal. The handheld embossing seal has lightened weight, which facilitates ease in portability, and is suitable for small quantity embossing. The desktop embossing seal is stable in operating, and thus is suitable for large quantity embossing.

The handheld embossing seal has lightened weight and facilitates ease in portability as mentioned above. However, during the operation, a user holds the handheld embossing seal, and makes an embossing element combine with an embossing plate underneath to emboss the document by pressing a grip. For the convenience of hand holding, the handheld embossing seal can be pressed by the user's palm only, and cannot be put on the desk to disperse the force. Thus, the handheld embossing seal is only suitable for small quantity embossing. The desktop embossing seal has a larger base to offer stable support. However, the desktop embossing seal is large and heavy, and thus is not convenient in portability. As a result, the desktop embossing seal is usually put on a fixed location and is for mass embossing.

Since both the handheld embossing seal and the desktop embossing seal have their respective shortcomings, the applicability would be enhanced if a supporting device is invented for combining with the handheld embossing seal to be stably put on the desktop and to disperse the force.

In addition, the bases of different handheld embossing seals may have different lengths and heights. Thus, the applicability would be limited if the above-mentioned supporting device is only adapted for one single or few size dimensions of the handheld embossing seals.

To overcome the shortcomings, the present invention provides a positioning base for an embossing seal to mitigate or obviate the aforementioned problems.

SUMMARY OF THE INVENTION

The main objective of the present invention is to provide a positioning base for an embossing seal that can be assembled with a handheld embossing seal to solve the problem that the handheld embossing seal cannot be put on the desk to be stably operated.

The positioning base for an embossing seal has a stand having a first end;

a second end opposite the first end;

a positioning segment extending from the first end to the second end;

two supports formed on a top surface of the stand, disposed in the first end, respectively disposed on two sides of the positioning segment, and being higher than a top surface of the positioning segment; and two limit blocks formed on the top surface of the stand, disposed in the second end, respectively disposed on the two sides of the positioning segment, and being higher than the top surface of the positioning segment; and a positioning assembly mounted securely on the stand, and having a mounting panel mounted securely on the positioning segment of the stand; and a clamping panel formed on an end of the mounting panel, disposed in the first end of the stand, and having a bending segment curvedly extending from the end of the mounting panel; and a clamping segment extending from the bending segment, disposed above the mounting panel, and having an inner end connected to the bending segment; and a pressing end opposite the inner end and being movable.

The positioning base for an embossing seal can be detachably assembled with a handheld embossing seal. The user can use the handheld embossing seal only or can assemble the handheld embossing seal with the positioning base together for use as a desktop embossing seal depending on the usage environment. When the positioning base and the handheld embossing seal are assembled, the positioning base provides a firm foundation with the handheld embossing seal, such that the handheld embossing seal can be put on a desk for use, thereby dispersing the force and enhancing the stability.

A soft pad may be mounted on a top of the mounting panel of the positioning assembly, thereby providing a soft contact surface with the bottom of the base of the handheld embossing seal to prevent friction.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
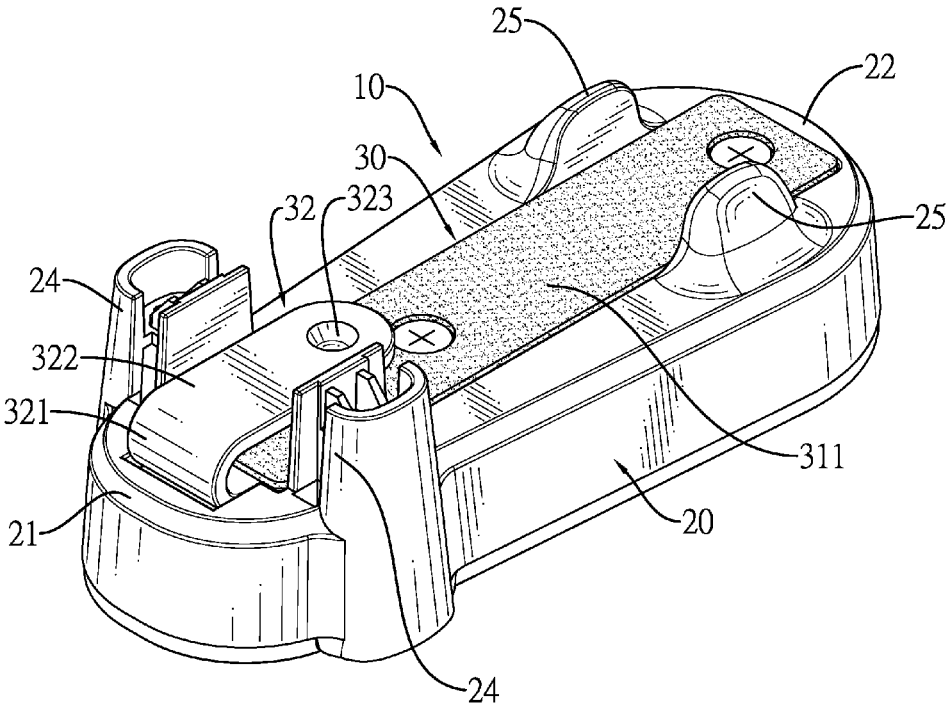
FIG. 1 is a perspective view of a positioning base for an embossing seal in accordance with the present invention.
Figure 2:
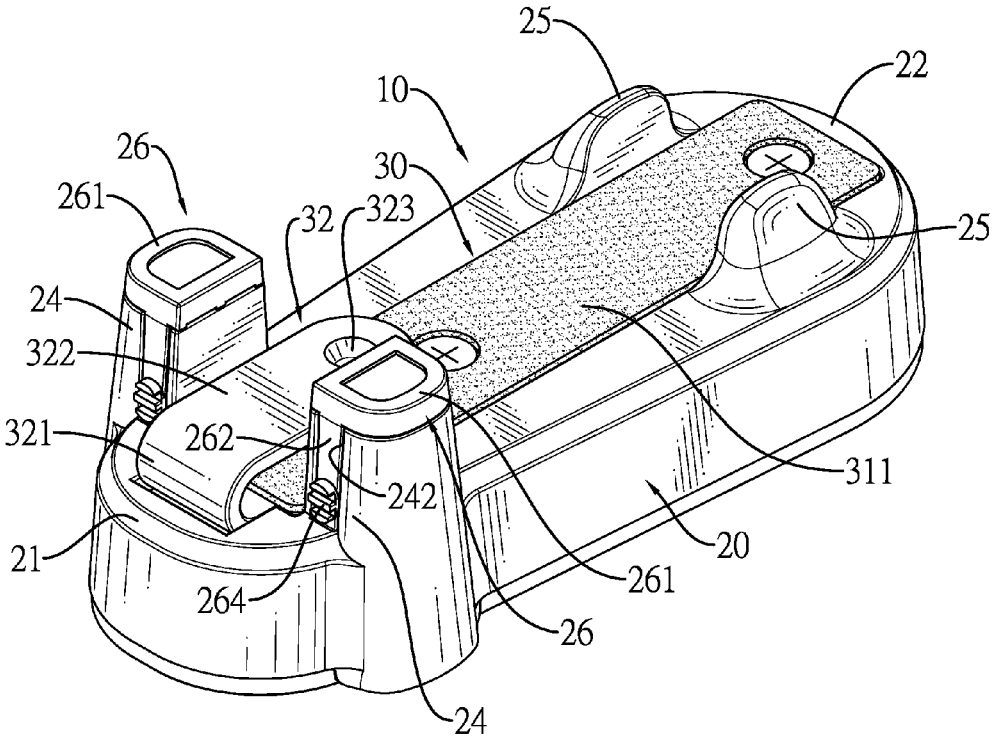
FIG. 2 is a perspective view of another preferred embodiment of a positioning base for an embossing seal in accordance with the present invention, showing two raising elements on two supports respectively.
Figure 3:
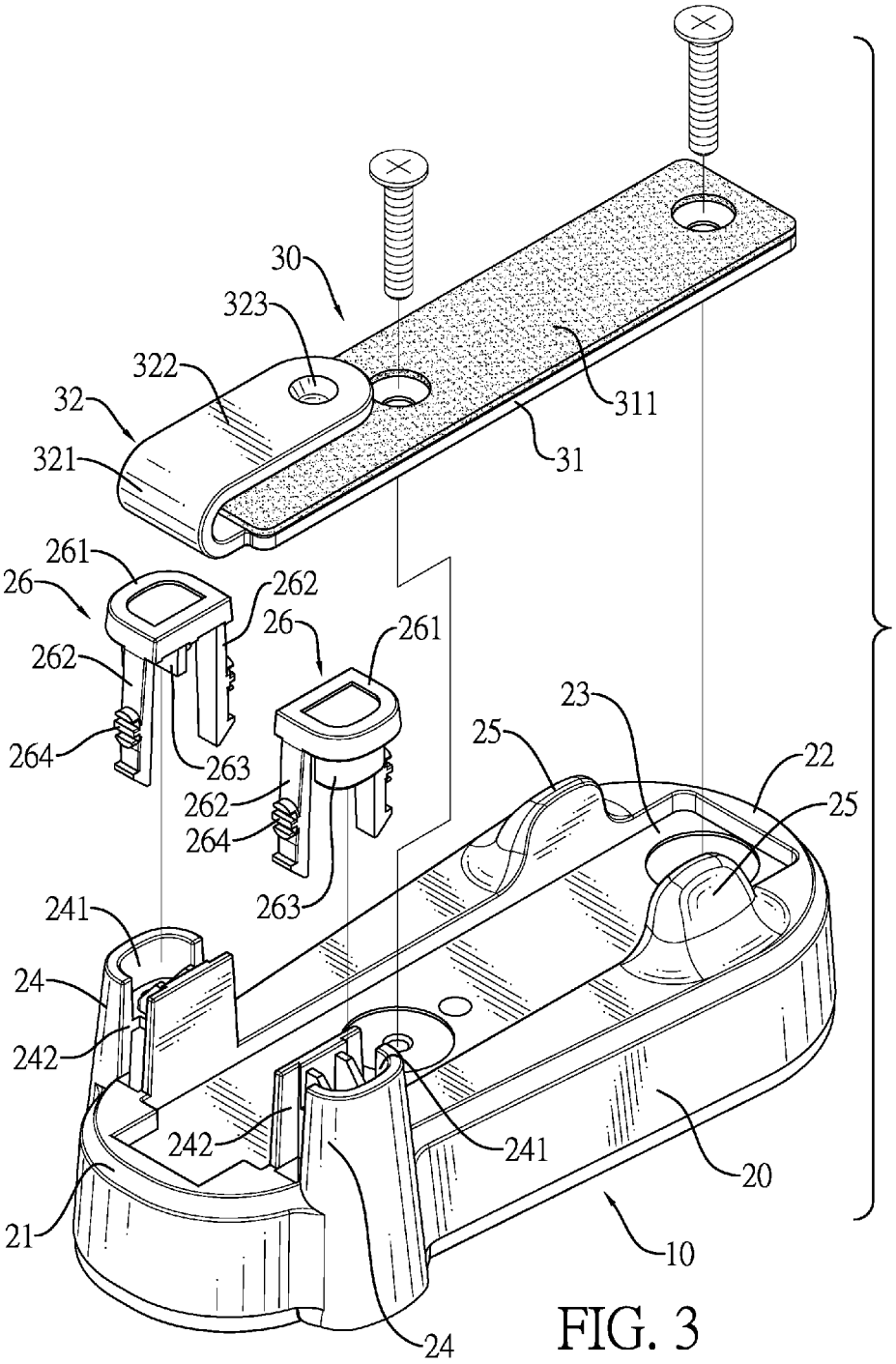
FIG. 3 is an exploded perspective view of the positioning base for an embossing seal in FIG. 2.

With reference to FIGS. 1 to 3, a positioning base 10 for an embossing seal in accordance with the present invention comprises a stand 20 and a positioning assembly 30. A preferred embodiment of the positioning base for an embossing seal as shown in FIGS. 2 and 3 further comprises two optional raising elements 26.

With reference to FIGS. 1 to 3, the stand 20 has a first end 21 and a second end 22 opposite each other. The stand 20 has a positioning segment 23 on its top and extending from the first end 21 to the second end 22. The positioning segment 23 may be a plane or a concaved recess with a top opening. Two supports 24 are formed on a top surface of the stand 20, are disposed in the first end 21, are respectively disposed on two sides of the positioning segment 23, and are higher than a top surface of the positioning segment 23. Two limit blocks 25 are formed on the top surface of the stand 20, are disposed in the second end 22, are respectively disposed on the two sides of the positioning segment 23, and are higher than the top surface of the positioning segment 23.

With reference to FIGS. 1 to 3, the positioning assembly 30 is mounted securely on the stand 20, and has a mounting panel 31 and a clamping panel 32. The mounting panel 31 is mounted securely on the positioning segment 23 of the stand 20, preferably by screws, rivets, engagement, adhesion and so on. When the positioning segment 23 is a concaved recess, the mounting panel 31 is mounted securely in the concaved recess. A top of the mounting panel 31 may be aligned with the top of the stand 20 in height. A soft pad 311 may be mounted on the top of the mounting panel 31, and a top of the soft pad 311 is higher than the top of the stand 20.

The clamping panel 32 is formed on an end of the mounting panel 31, is disposed in the first end 21 of the stand 20, and protrudes toward the second end 22. The clamping panel 32 has a bending segment 321 and a clamping segment 322. The bending segment 321 curvedly extends from the end of the mounting panel 31. The clamping segment 322 extends from the bending segment 321, is disposed above the mounting panel 31, and is disposed between the two supports 24 of the stand 20. The clamping segment 322 has an inner end connected to the bending segment 321 and a pressing end 323 opposite the inner end and being movable. The pressing end 323 may have a protrusion protruding downward.

Figure 4:
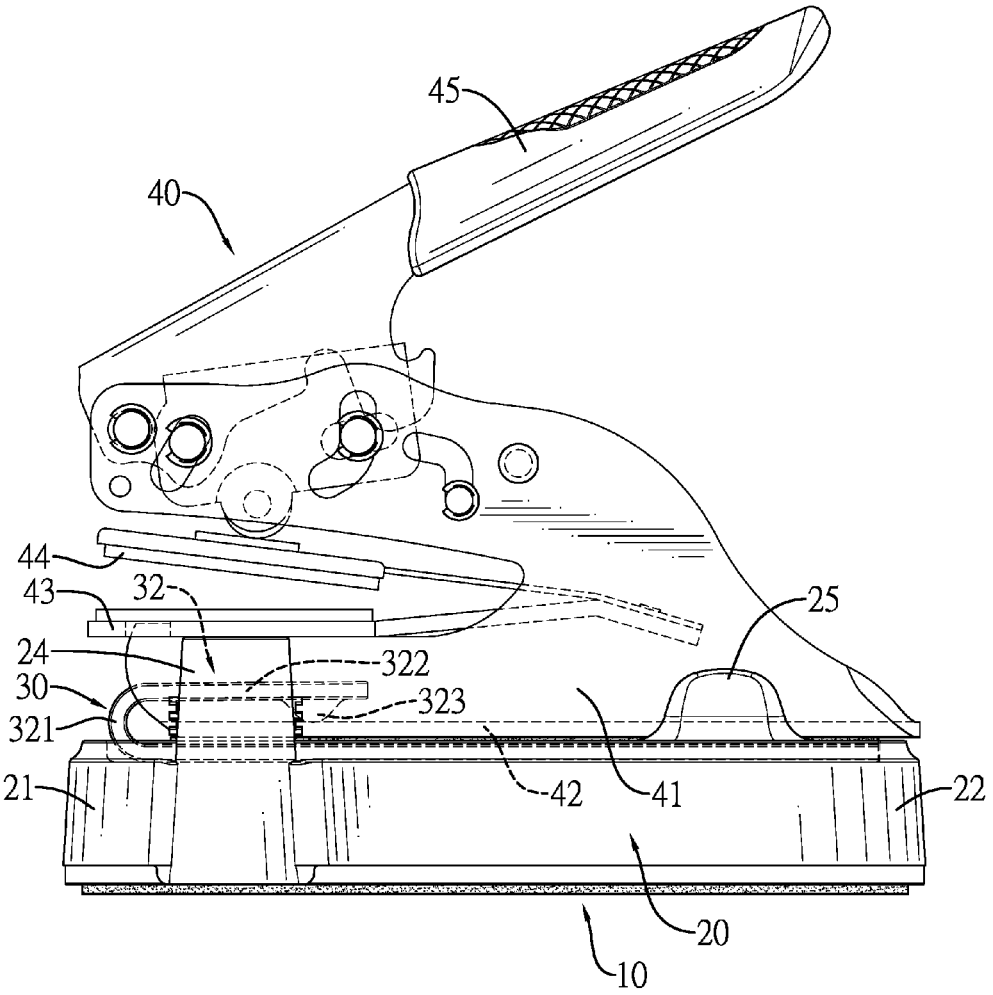
FIG. 4 is an operational side view of the positioning base for an embossing seal in FIG. 1, shown mounted with a low-bottom type handheld embossing seal to become a desktop embossing seal.
Figure 5:
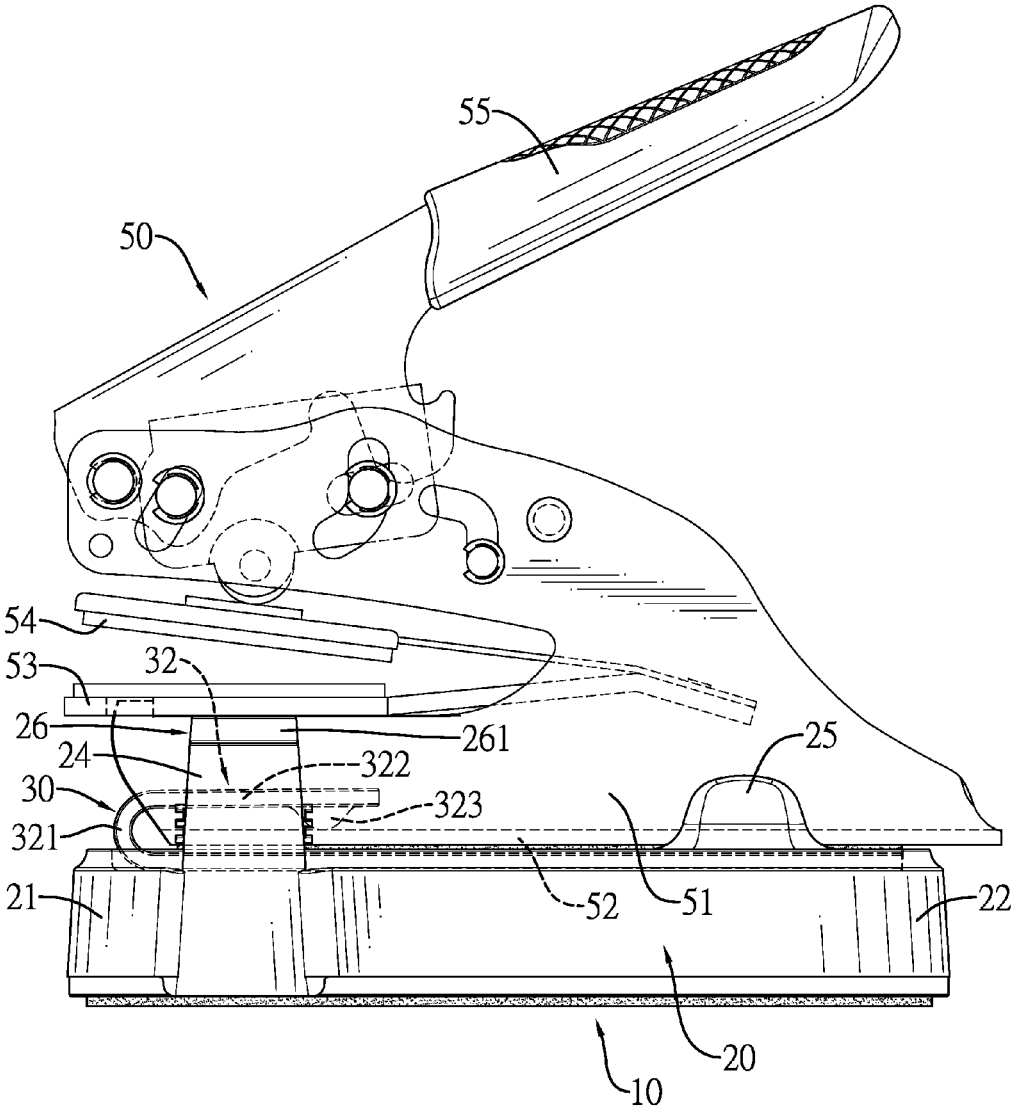
FIG. 5 is an operational side view of the positioning base for an embossing seal in FIG. 2, shown mounted with a high-bottom type handheld embossing seal to become a desktop embossing seal.

With reference to FIGS. 4 and 5, the handheld embossing seals 40, 50 generally include the following two types: the high-bottom type and the low-bottom type. The two types of the handheld embossing seals 40, 50 are the same in widths of bases 41, 51, but are different in heights of bottoms of their embossing plates 43, 53. The bottom of the embossing plate 43 of the low-bottom type handheld embossing seal 40 is lower than the bottom of the embossing plate 53 of the high-bottom type handheld embossing seal 50. Thus, in a preferred embodiment, the heights of the two supports 24 from the top of the stand 20 depend on a height difference between a bottom of the base 41 and the bottom of the embossing plate 43 of the conventional low-bottom type embossing seal 40. In addition, lengths of the handheld embossing seals 40, 50 may be different due to the different models and specifications. But the difference in the lengths of the handheld embossing seals 40, 50 does not affect the combination of the said handheld embossing seals 40, 50 and the positioning base 10 for an embossing seal.

When the low-bottom type embossing seal 40 is assembled on the positioning base 10, the base 41 of the embossing seal 40 is mounted on the positioning segment 23, is attached to the soft pad 311, and is disposed and limited between the two supports 24 and the two limit blocks 25. The positioning assembly 30 is mounted into a portion between the base 41 and the embossing plate 43 of the handheld embossing seal 40, and the pressing end 323 of the clamping segment 322 resiliently abuts the bottom panel 42 of the base 41. The supports 24 provide support to a bottom of a side portion of the embossing plate 43 that extends out of the base 41. Therefore, the handheld embossing seal 40 and the positioning base 10 are combined together to become a desktop embossing seal. The positioning base 10 provides a firm foundation with the handheld embossing seal 40, such that the handheld embossing seal 40 can be put on the desk for use. With reference to FIGS. 1 and 4, as a result, the document to be embossed is inserted between the embossing plate 43 and an embossing element 44 after the positioning base 10 and the handheld embossing seal 40 are assembled together. Then the user makes the embossing element 44 emboss the document by the grip 45. When applying force on the embossing, the positioning base 10 can disperse the force on the desk.

With reference to FIGS. 2 and 3, to make the positioning base 10 adapted to the high-bottom type handheld embossing seal, the stand 20 further comprises two raising elements 26 detachably mounted on tops of the two supports 24 respectively. In a preferred embodiment as shown in FIGS. 2 and 3, each support 24 has a mounting hole 241 and two elongated recesses 242. The mounting hole 241 is formed in the top of the support 24. The two elongated recesses 242 are formed in the support 24, extend downward from the top of the support 24, communicate with the mounting hole 241, and respectively face the first end 21 and the second end 22.

Each raising element 26 has a supporting pad 261, two rod segments 262, two operating segments 264, and a mounting segment 263. The supporting pad 261 is disposed on the top of the support 24, thereby increasing the height by adding the supporting pad 261 on the support 26. The two rod segments 262 are respectively formed on two ends of a bottom of the supporting pad 261, and are mounted in the two elongated recesses 242 of the support 24 respectively. The two operating segments 264 are respectively formed on outer surfaces of the two rod segments 262, and are exposed out of the support 24. The mounting segment 263 is formed on the bottom of the supporting pad 261, and is mounted in the mounting hole 241 of the support 24.

With reference to FIGS. 2 and 5, when the positioning base 10 is assembled with the high-bottom type handheld embossing seal 50, the base 51 of the handheld embossing seal 50 is mounted on the positioning segment 23 of the positioning base 10 and is disposed between the two supports 24 and the two limit blocks 25. The positioning assembly 30 is mounted into a portion between the base 51 and the embossing plate 53 of the handheld embossing seal 50, and the pressing end 323 of the clamping segment 322 resiliently abuts the bottom panel 52 of the base 51. The supports 24 and the supporting pad 261 of the raising element 26 provide support to a bottom of a side portion of the embossing plate 53 that extends out of the base 51. Therefore, the handheld embossing seal 50 and the positioning base 10 are combined together to become a desktop embossing seal. The positioning base 10 provides a firm foundation with to the handheld embossing seal 50, such that the handheld embossing seal 50 can be put on the desk for use. As a result, the document to be embossing is inserted between the embossing plate 53 and an embossing element 54 after the positioning base 10 and the handheld embossing seal 50 are assembled together. Then the user makes the embossing element 54 emboss the document by the grip 55. When applying force on the embossing, the positioning base 10 can disperse the force on the desk.

To sum up, the positioning base for an embossing seal can be detachably assembled with a handheld embossing seal. The user can use the handheld embossing seal only or can assemble the handheld embossing seal with the positioning base together to use as a desktop embossing seal depending on the usage environment. When the positioning base and the handheld embossing seal are assembled, the positioning base provides a firm foundation with the handheld embossing seal, such that the handheld embossing seal can be put on a desk for use, thereby dispersing the force and enhancing the stability.

On the other hand, the supports and the limit blocks on the top of the stand can limit the two sides of the base of the handheld embossing seal. The positioning assembly clamps an end of the base of the handheld embossing seal. The other end of the base of the handheld embossing seal is not fixed and limited. Therefore, the positioning base can be adapted to the handheld embossing seals of different lengths.

In addition, when the height of the support from the top of the stand corresponds to the height of the embossing plate of the low-bottom type handheld embossing seal, the raising elements can be mounted on the support to make the positioning base adapted to the high-bottom type handheld embossing seal. As a result, the positioning base of the present invention can be adapted to the handheld embossing seals of different size dimensions and specifications, thereby enhancing the applicability.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A positioning base for an embossing seal, the positioning base comprising:

a stand having a first end;

a second end opposite the first end;

a positioning segment extending from the first end to the second end;

two supports formed on a top surface of the stand, disposed in the first end, respectively disposed on two sides of the positioning segment, and being higher than a top surface of the positioning segment; and two limit blocks formed on the top surface of the stand, disposed in the second end, respectively disposed on the two sides of the positioning segment, and being higher than the top surface of the positioning segment; and a positioning assembly mounted securely on the stand, and having a mounting panel mounted securely on the positioning segment of the stand; and a clamping panel formed on an end of the mounting panel, disposed in the first end of the stand, and having a bending segment curvedly extending from the end of the mounting panel; and a clamping segment extending from the bending segment, disposed above the mounting panel, and having an inner end connected to the bending segment; and a pressing end opposite the inner end and being movable.

2. The positioning base as claimed in claim 1 further comprising:

two raising elements detachably mounted on tops of the two supports of the stand respectively.

3. The positioning base as claimed in claim 2, wherein each of the two supports has a mounting hole formed in the top of said support; and two elongated recesses formed in said support, extending downward from the top of said support, communicating with the mounting hole, and respectively facing the first end and the second end; and each of the two raising elements has a supporting pad disposed on the top of a corresponding one of the supports;

two rod segments respectively formed on two ends of a bottom of the supporting pad, and mounted in the mounting hole and the two elongated recesses of the corresponding support;

two operating segments respectively formed on outer surfaces of the two rod segments, and exposed out of the corresponding support; and a mounting segment formed on the bottom of the supporting pad, and mounted in the mounting hole of the corresponding support.

4. The positioning base as claimed in claim 3, wherein the positioning segment of the stand is a concaved recess, and the mounting panel of the positioning assembly is mounted securely in the concaved recess.

5. The positioning base as claimed in claim 4, wherein the pressing end of the clamping segment of the clamping panel is a protrusion protruding downward.

6. The positioning base as claimed in claim 5, wherein the positioning assembly has a soft pad mounted on a top of the mounting panel.

7. The positioning base as claimed in claim 1, wherein the positioning segment of the stand is a concaved recess, and the mounting panel of the positioning assembly is mounted securely in the concaved recess.

8. The positioning base as claimed in claim 1, wherein the pressing end of the clamping segment of the clamping panel is a protrusion protruding downward.

9. The positioning base as claimed in claim 1, wherein the positioning assembly has a soft pad mounted on a top of the mounting panel.

* * * * *